US006694651B1

(12) United States Patent
Shuen

(10) Patent No.: US 6,694,651 B1
(45) Date of Patent: Feb. 24, 2004

(54) DECORATIVE AND ATTRACTIVE EXHAUST MECHANISM WITH ADJUSTABLE ANGELS

(75) Inventor: Shun Tian Shuen, San Chung (TW)

(73) Assignee: Janchy Enterprise Co., Ltd., Chung (TW)

( * ) Notice: Subject to any disclaimer, the term of this patent is extended or adjusted under 35 U.S.C. 154(b) by 9 days.

(21) Appl. No.: 10/256,146

(22) Filed: Sep. 27, 2002

(51) Int. Cl.[7] ..... G09F 21/04

(52) U.S. Cl. ..... 40/591; 40/591; 40/660

(58) Field of Search ..... 40/591, 660

(56) References Cited

U.S. PATENT DOCUMENTS 6,238,122 B1 * 5/2001 Brooks et al. ..... 403/24

* cited by examiner

*Primary Examiner*—Cassandra H. Davis
(74) *Attorney, Agent, or Firm*—Bacon & Thomas, PLLC

(57) ABSTRACT

A decorative and attractive exhaust mechanism with adjustable angles consists of one rotary multi-direction slip-on assembly that extends along with the size of the exhaust, one decorative plate going with the user's preferences and requirements to provide decoration and attraction and one plastic exhaust cover installed on one end of the multi-direction slip-on assembly so as to provide various decoration and attraction and could be applied to all kinds of automobile exhausts.

8 Claims, 16 Drawing Sheets

DECORATIVE AND ATTRACTIVE EXHAUST MECHANISM WITH ADJUSTABLE ANGELS

FIELD OF THE INVENTION

The present invention refers to a decorative and attractive exhaust mechanism with adjustable angles. More elaborately, it is an exhaust mechanism with rotary angles easy to assembly and widely applied to all kinds of automobile exhausts.

BACKGROUND OF THE INVENTION

Traditional automobile exhausts are single pipes. Users who want to promote the horsepower of the automobile usually replace the single pipe with duplex or more exhausts. This might fulfill their demanding performance yet lack of decoration and attraction.

Though the structure and application of such automobile exhausts seem to work just fine, the inventor of the present invention who has used and observed the structure of traditional exhausts found such exhausts only provided one function which was monotonous and lagging behind modern requirements for novelty and variety. Therefore, there is much for improvement in traditional exhausts.

In light of the demands in the market and the problems for traditional exhausts, the inventor of the present invention put years of experience in the research and the development of "a decorative and attractive exhaust mechanism with adjustable angles".

SUMMARY OF THE INVENTION

The objective of the present invention is to provide a decorative and attractive exhaust mechanism with adjustable angles applicatory to exhausts in different specifications, diameters and numbers. Through the fixing plate installed in accordance with the user's preference and requirement and the formative decorative flake, a rotary multi-direction slip-on assembly that extends along with the size of the exhaust and one formative exhaust cover installed on one end of the multi-direction slip-on assembly, the exhaust is given a great variety in application, decoration and attraction.

In the following, the embodiment illustrated is used to describe the detailed structural characteristics and operation action for the present invention. The figures are not intended to impose any restriction on the form of the present invention. Any modification or changes to the present invention with the same inventive spirits are protected in the present invention.

DETAILED DESCRIPTION OF THE INVENTION

The present invention is a decorative and attractive exhaust mechanism with adjustable angles. It consists of one multi-direction slip-on assembly 1, one formative cover 2 and one decorative plate 3.

Figure 1:
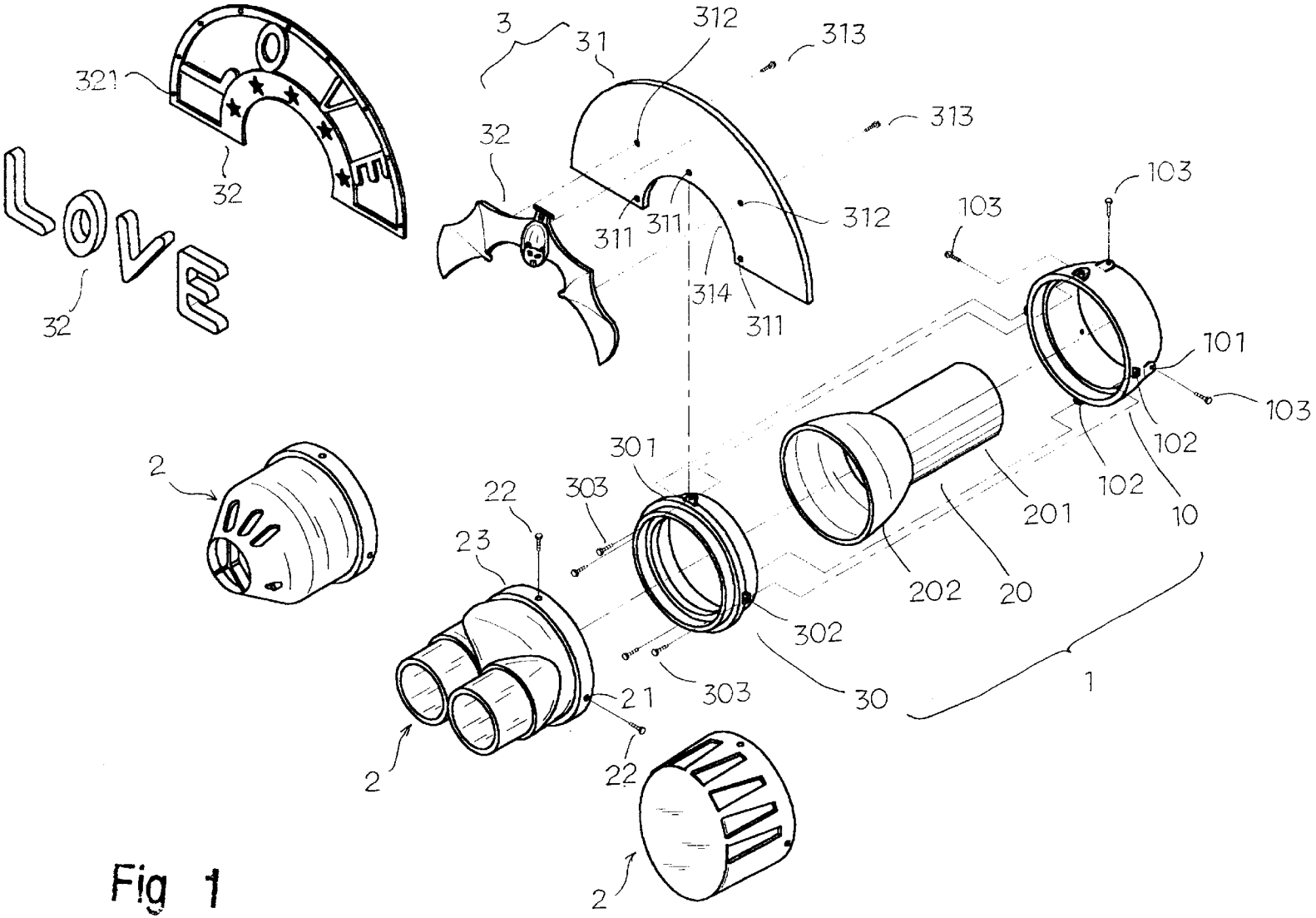
FIG. 1 is a diagram about the detailed decomposition of the structure for the present invention.

Please refer to FIG. 1 in which the multi-direction slip-on assembly 1 is a rotary multi-direction shaft composed of one positioning inlay 10, one multi-direction connector 20 and one linking ring 30. The positioning inlay 10 is a curved assembly that could be slipped on the curved connecting interface 202 of the multi-direction connector 20. On the outside of its ring body is set with several adjustable positioning holes 101 for the positioning inlay 10 adjusted as needed to be fixed on the connecting interface 202 with screws 103. The bolt lock hole 102 could be locked to the bolt lock body 302 of the linking ring 30 with bolts 303.

The multi-direction connector 20 consists of the slip-on shaft 201 and the curved connecting interface 202 wherein the slip-on shaft 201 is a hollow shaft with one end connected to the automobile exhaust and the replacing interface 202 is slipped through the positioning inlay 10 with one end connecting to the linking ring 30.

The linking ring 30 is a slip-on ring with an opening on either end. A blocker 301 is set on the exterior of the ring at adequate distance with several bolt locks 302 at equal distances on the top so as to fix to the bolt lock hole 102 of the positioning inlay 10 by passing the bolt 303 through the screw hole of the fixing plate 31.

When installing the multi-direction slip-on assembly 1, the above adjusted positioning inlay 10 is passed through the positioning hole 101 to the connecting interface 202 of the multi-direction connector 20 and fixed on the multi-direction connector 20 with the bolt 103. The bolt lock 302 of the linking ring 30 and the screw hole 311 of the positioning plate 31 are connected to the bolt lock hole 102 of the positioning inlay 10 by means of the bolt 303. This allows the installation and the rotation of the formative exhaust cover 2 and the decorative plate 3 for the application to exhausts in all kinds, specifications and sizes.

The formative exhaust cover 2 is a replaceable cover with one end as the opening inlay interface 23 whose exterior is installed with several screw holes 21 so as to connect to the linking ring 30 with the bolt 22. The other end of the cover 2 is a changeable molding with several openings or holes for the purpose of ventilation.

The decorative plate 3 is composed of the fixing flake 31 and the decorative plate 32 whose size and shape could be adjusted in accordance with the user's preference and requirements.

The fixing plate 31 could be made of any material (such as metal, wood) into any shape with depth, such as semicircle, rectangle or any shape (as shown in FIG. 3, FIG. 6 to FIG. 10). The surface is fixed by passing the bolt 313 through the lock hole 312 or through adhesion (such as twin adhesive) so as to connect the decorative flake 32, thus provides decoration and attraction (shown in FIG. 1). On the back of the decorative flake 32 there is a pair of screw holes corresponding to the lock hole 312 for the insertion and fixing of the screw 313.

Figure 2:
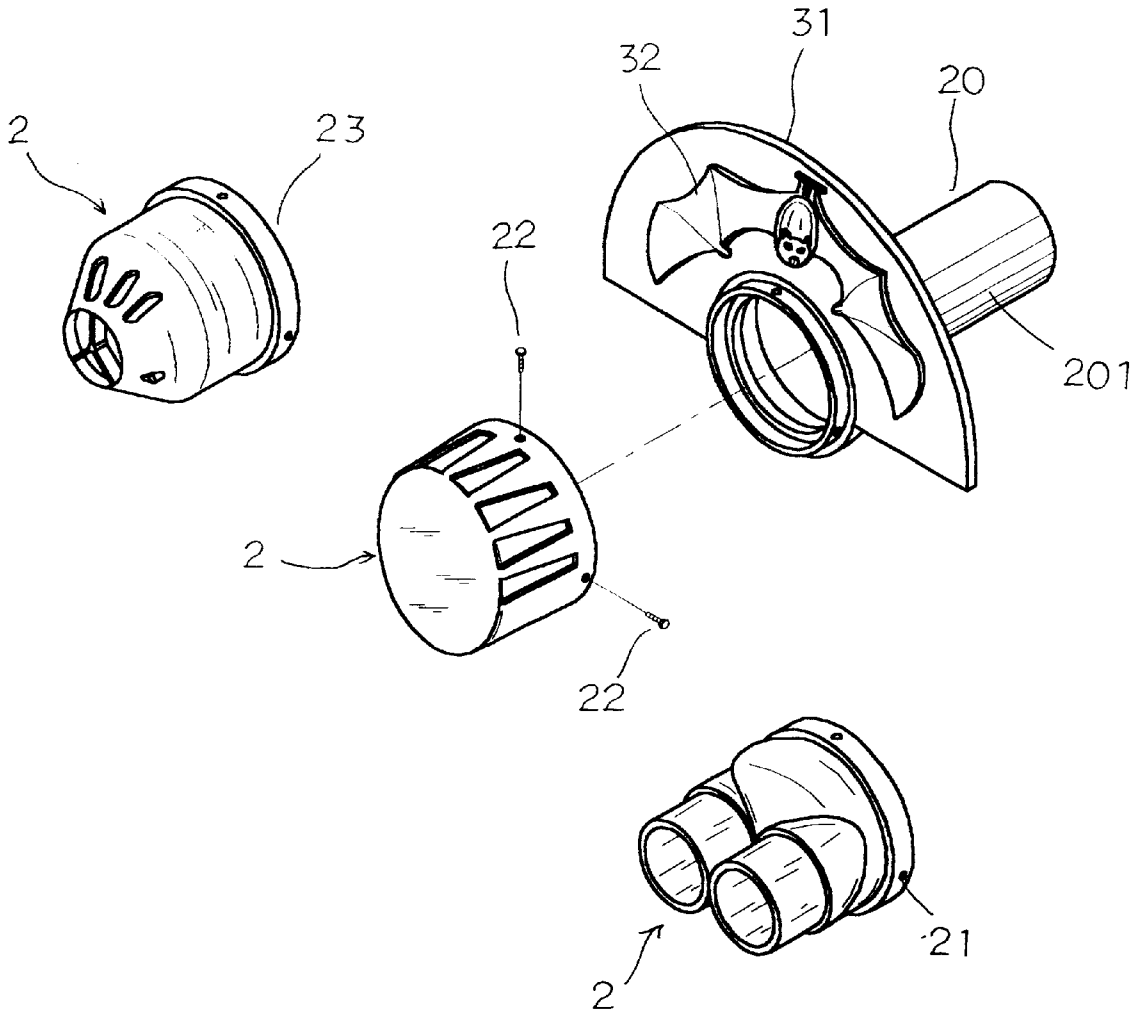
FIG. 2 is a diagram about the first applied appearance for the present invention.
Figure 2A:
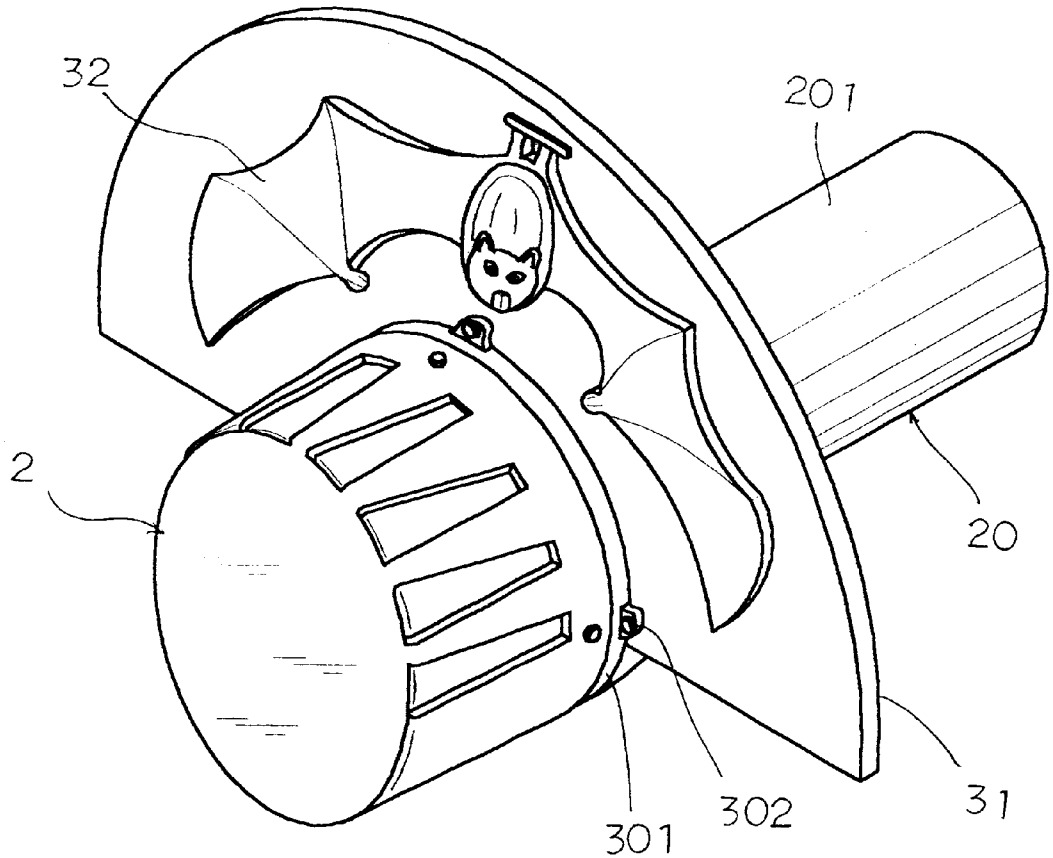
FIG. 2A is a diagram about the first applied combination for the present invention.
Figure 2B:
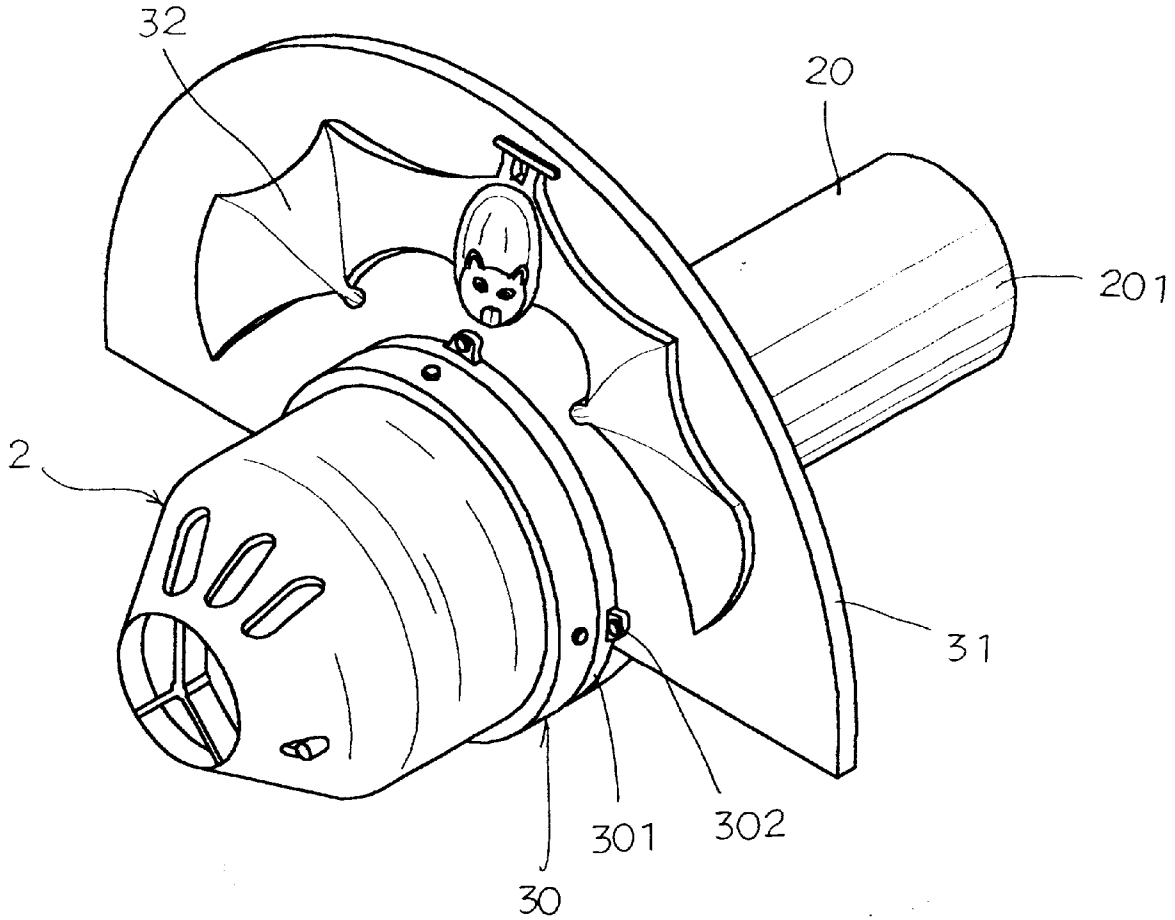
FIG. 2B is a diagram about the first applied combination for the present invention.
Figure 2C:
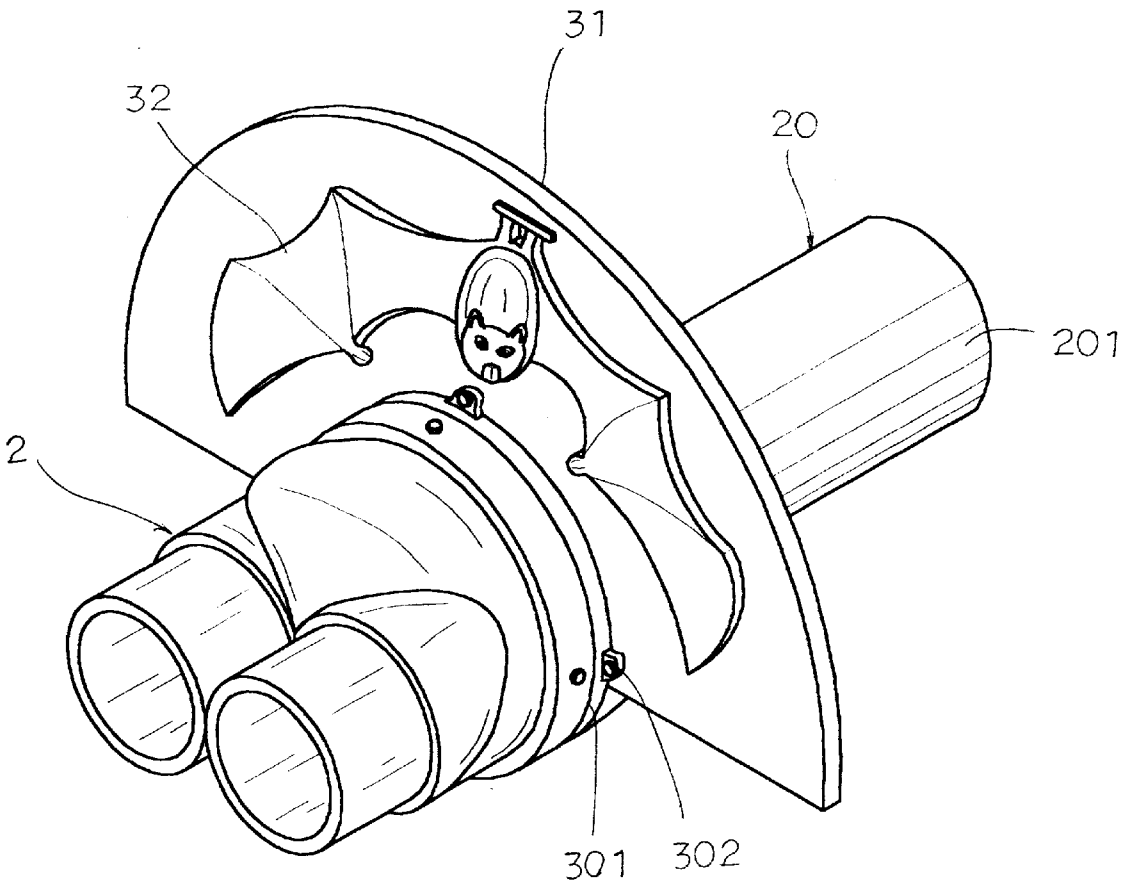
FIG. 2C is a diagram about the first applied combination for the present invention.
Figure 3:
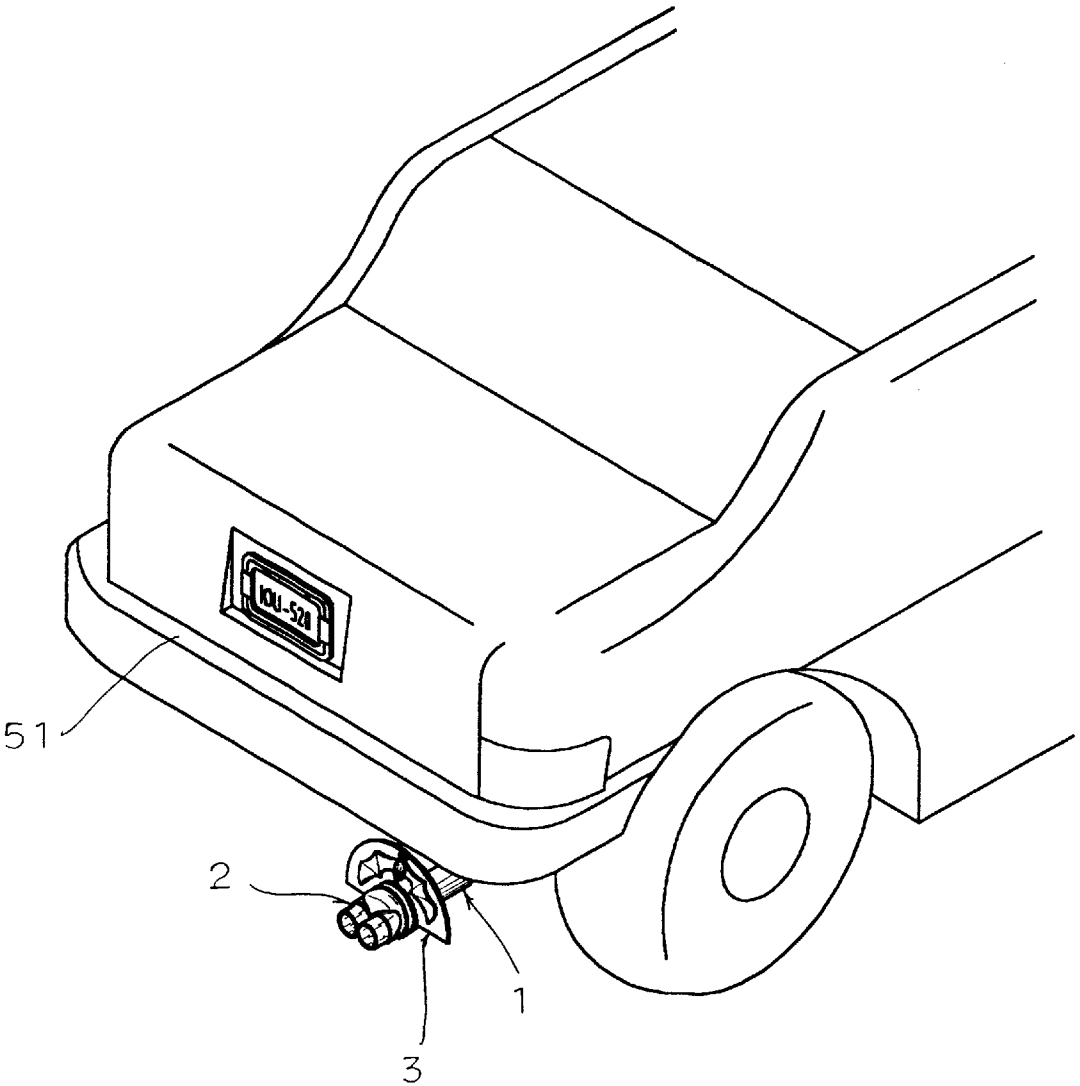
FIG. 3 is a diagram about the applied installation for the present invention.

Beneath the fixing plate 31 there is a curved breach 314 at an adequate distance that go with the linking ring 30. Along the curved breach 314 of the fixing plate 31 there are several screw holes 311 for the fixing plate 31 to fix on the linking ring 30 of the multi-direction slip-on assembly by inserting the bolt 313 to the lock body 302 of the linking ring 30 (as shown in FIGS. 2A, B and C) or to fix to the multi-direction slip-on assembly 1 by welding with the linking ring 30 (as shown in FIG. 2). Besides, in order to meet the requirement of molding, several LED 321 could be set at equal distances on the edge of the fixing plate 31 of the decorative plate 3 (as shown in FIGS. 5–10).

Figure 10:
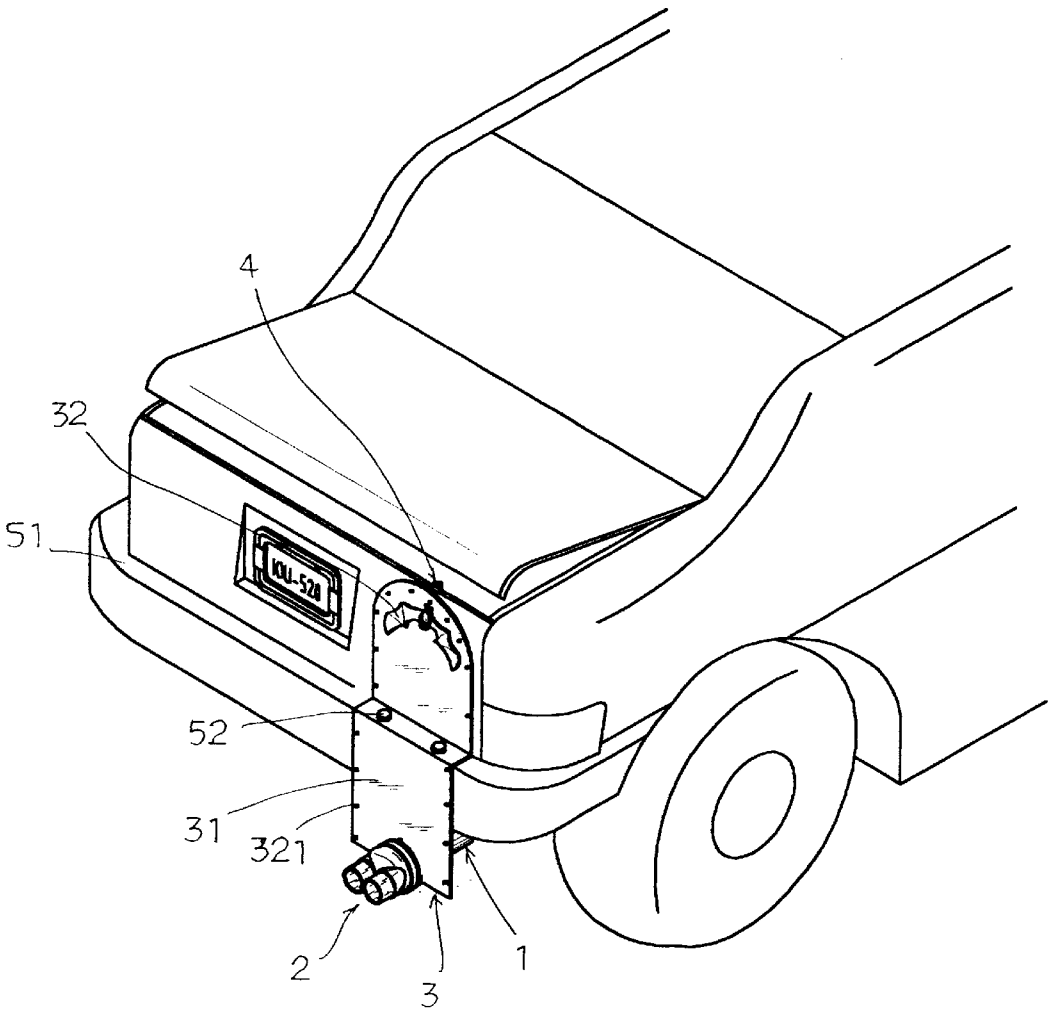
FIG. 10 is a diagram about seventh applied appearance decomposition for the present invention.
Figure 11:
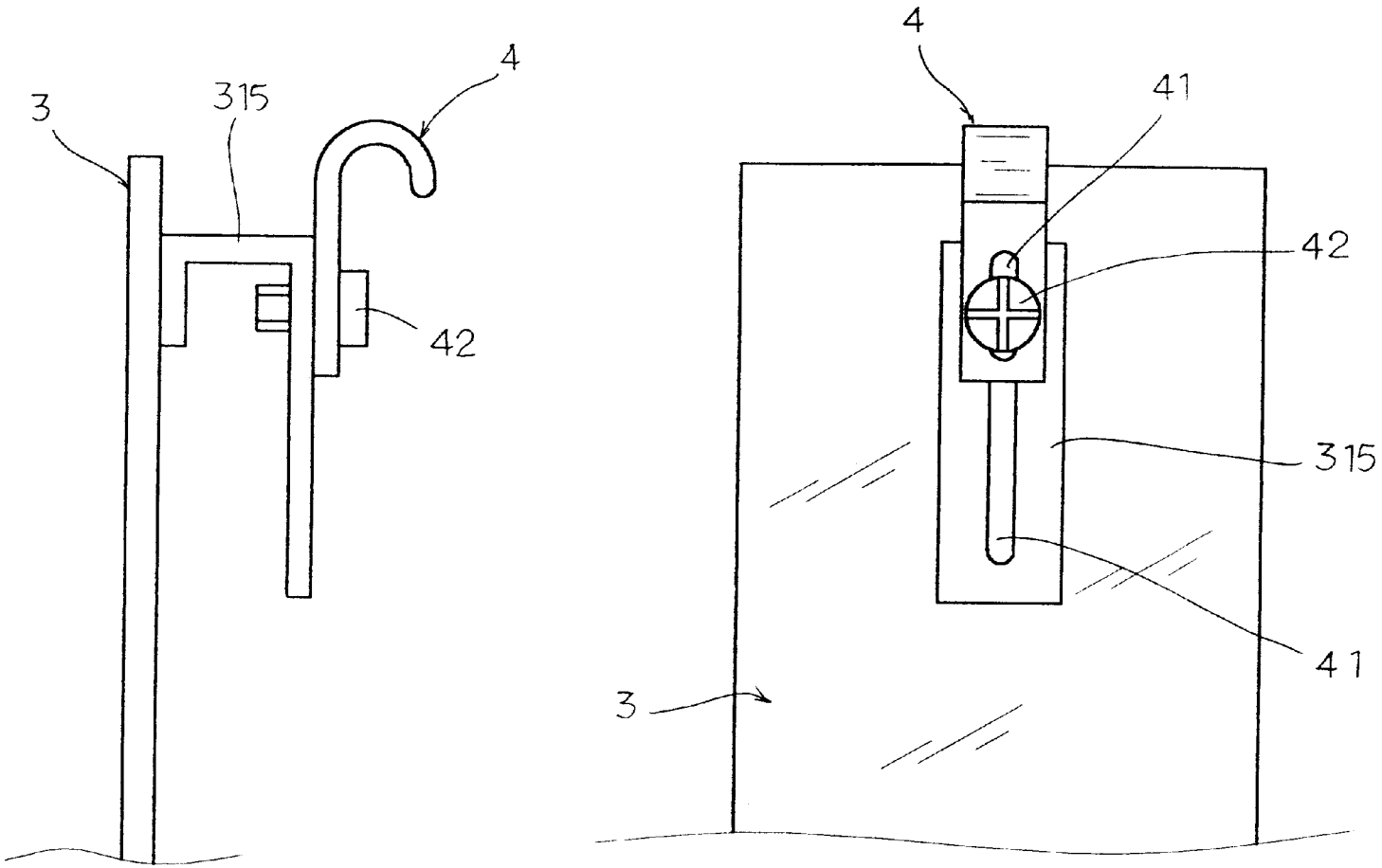
FIG. 11 is a diagram about the structure of the hook and the spacer for the present invention.
Figure 12:
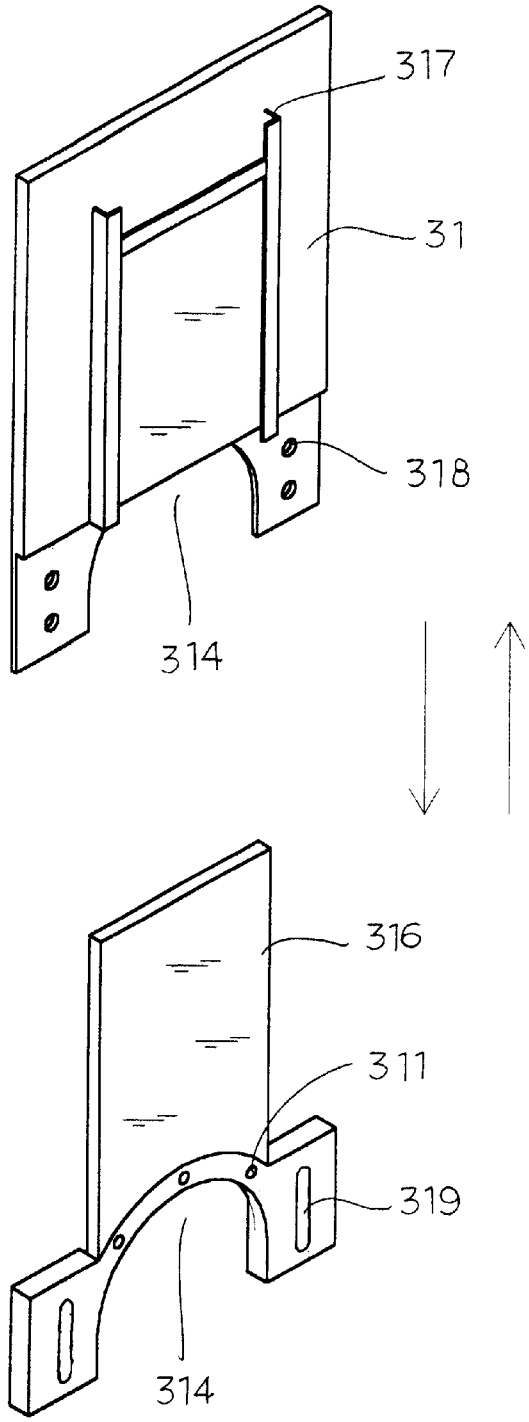
FIG. 12 is a diagram about another application of the fixing plate for the present invention.
Figure 13:
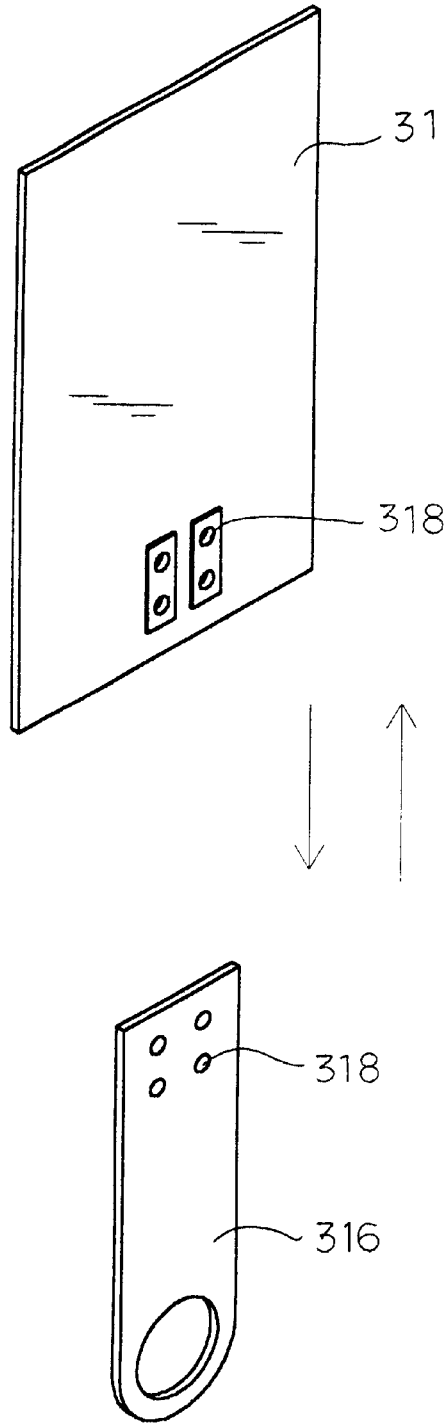
FIG. 13 is a diagram about still another application of the fixing plate for the present invention.

Furthermore, on the back of the fixing plate 31 of the decorative plate 3 there is a [-shaped spacer 315 at an adequate distance with an adjustable trough 41. On one side of the spacer 315 there is a hook 4 for the adjustable trough 41 (as shown in FIG. 11) to hook onto the trunk of the automobile (as shown in FIG. 10). The hook 4 and the spacer could be passed through the adjustable trough 41 with the bolt 42 so that the hook is able to move up and down to adjust the height.

Figure 4:
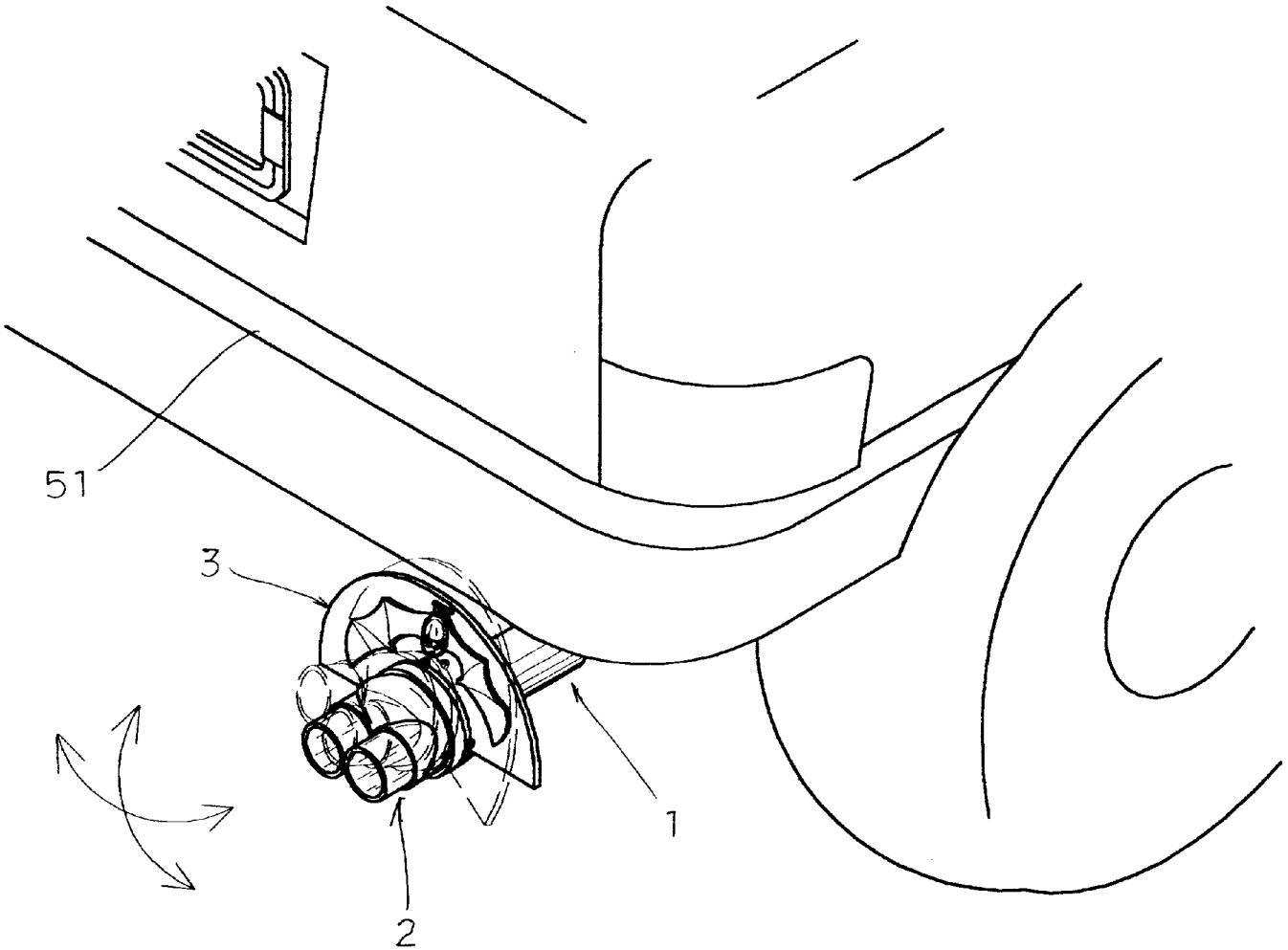
FIG. 4 is a diagram about the applied operation for the present invention.
Figure 5:
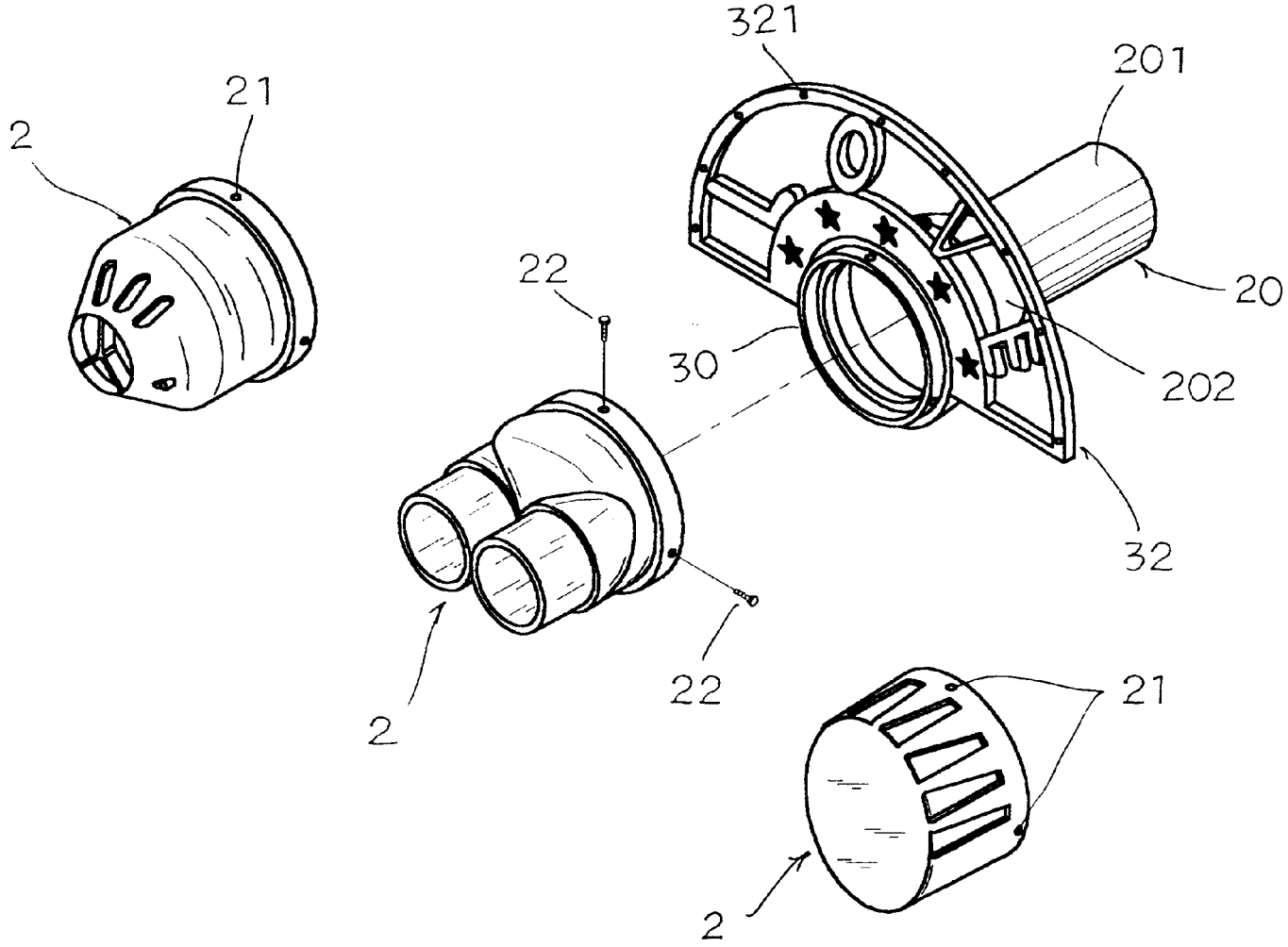
FIG. 5 is a diagram about second applied appearance decomposition for the present invention.
Figure 6:
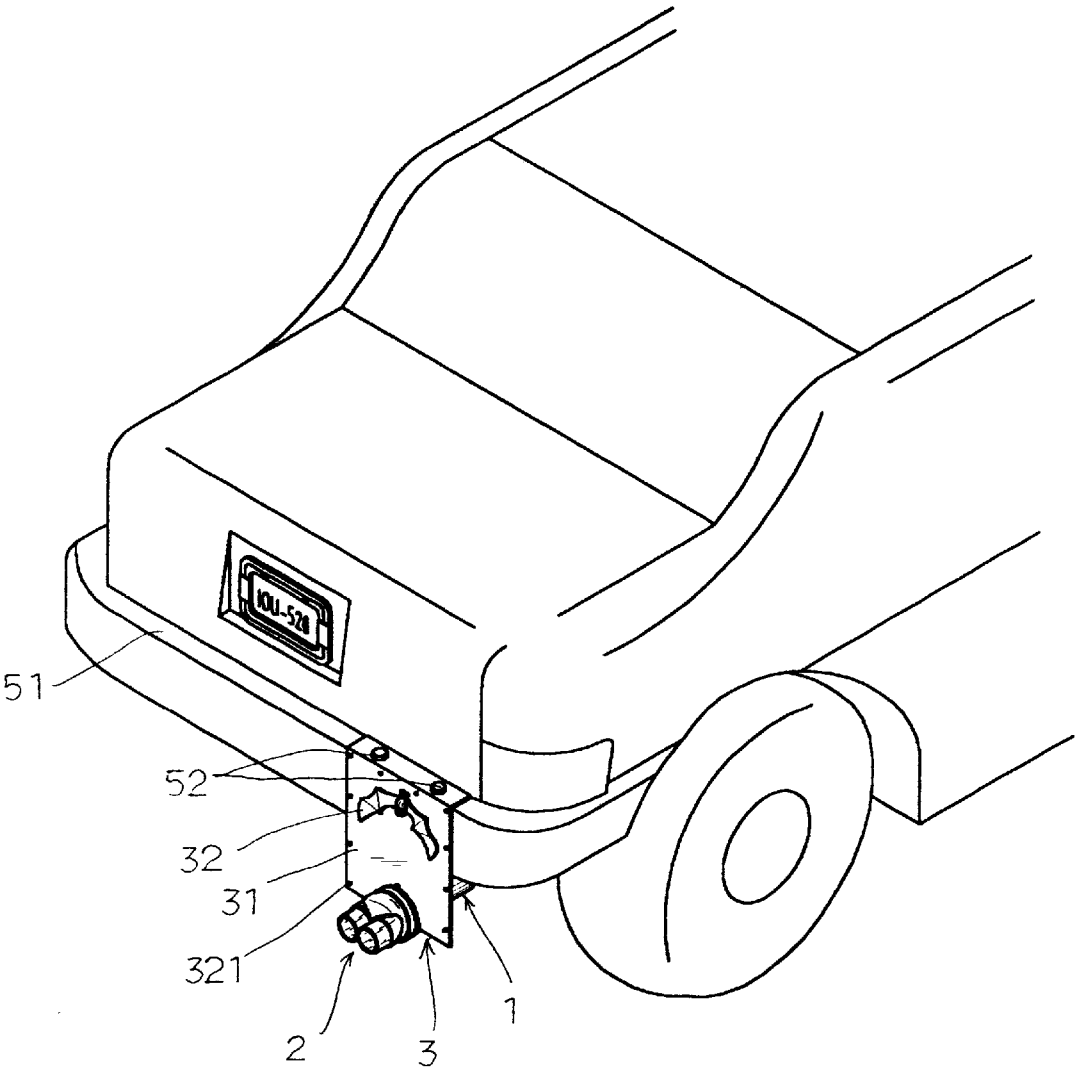
FIG. 6 is a diagram about third applied installation for the present invention.
Figure 7:
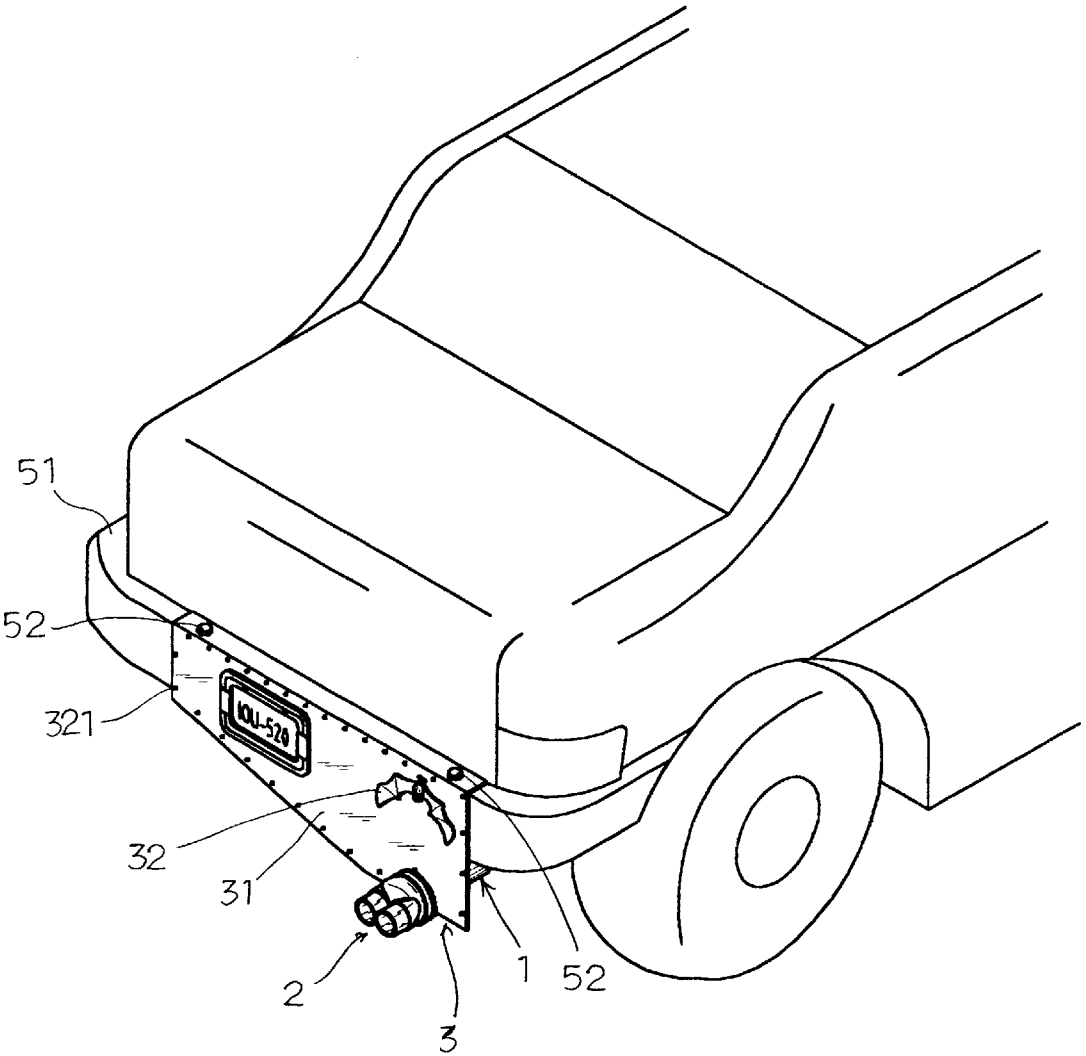
FIG. 7 is a diagram about forth applied appearance decomposition for the present invention.
Figure 8:
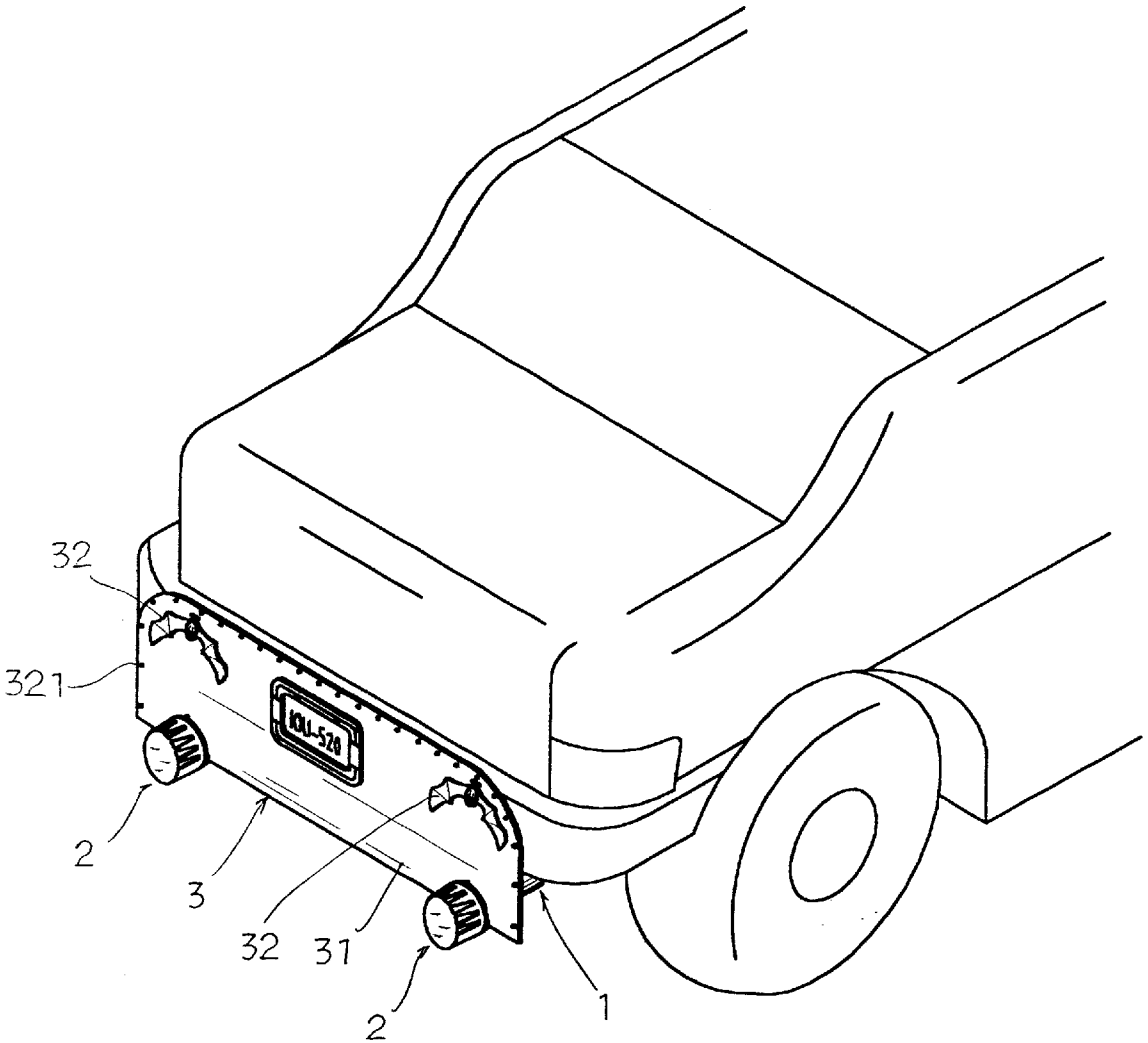
FIG. 8 is a diagram about fifth applied appearance decomposition for the present invention.
Figure 9:
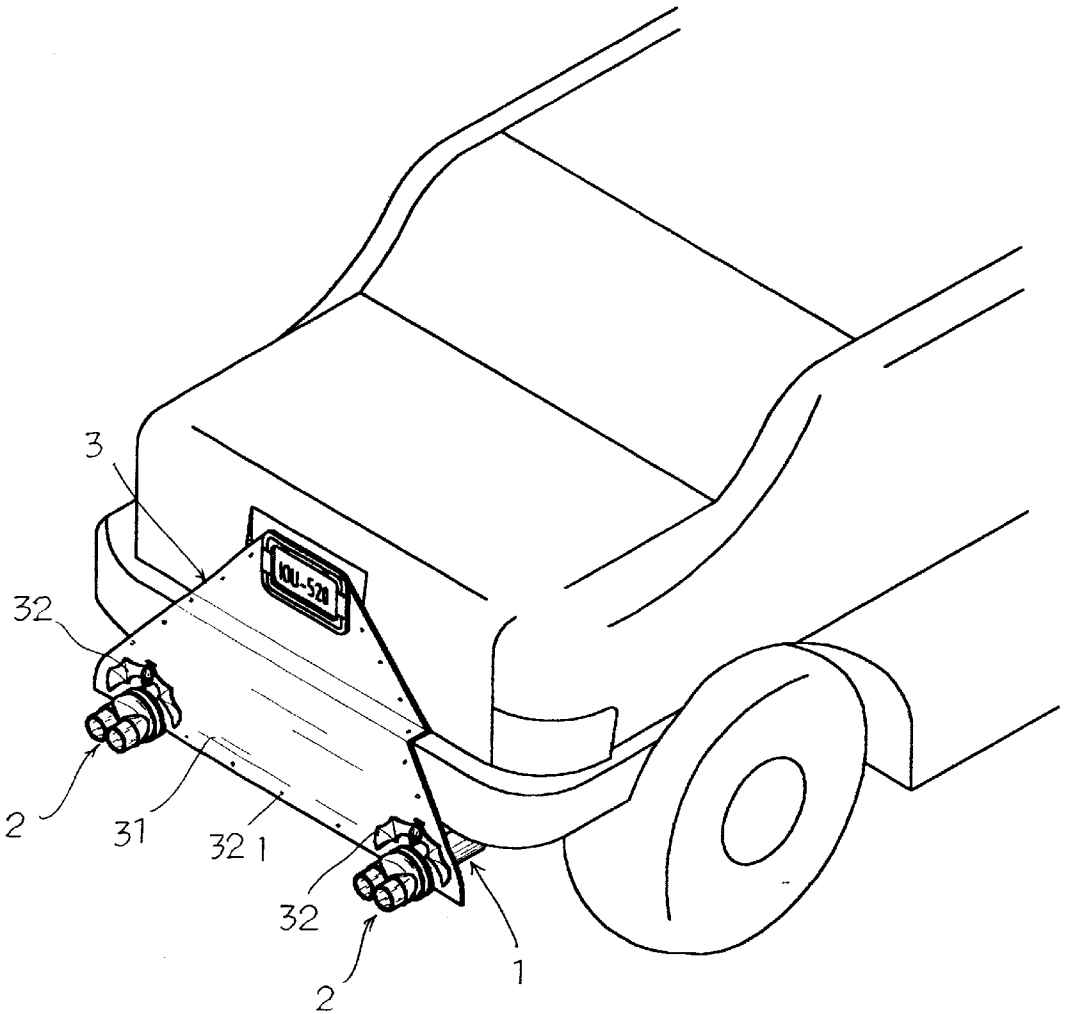
FIG. 9 is a diagram about sixth applied appearance decomposition for the present invention.

The above components form a complete decorative and attractive exhaust mechanism with adjustable angles. Please refer to FIG. 2 to FIG. 10. During the installation (please refer to FIG. 1, FIG. 3 and FIG. 4), the decorative and attractive exhaust mechanism with adjustable angles for the present invention is installed at the opening of the automobile exhaust which passes through the slip-on shaft 201 of the multi-direction slip-on connector 20. After adjusting the positioning inlay 10 to an adequate angle, lock it to the slip-on shaft 201 of the multi-direction connector 20 by passing the bolt 103 through the lock hole 102, which is easy and fast. Moreover, the decorative plate 3 could be connected to the multi-direction slip-on assembly 1 by welding (as shown in FIG. 2) or bolting (ass shown in FIGS. 2A, B and C). In this way, the decorative flake 32 (bolted or adhered) and the fixing plate 31 could be replaced by the user's favor, thus highlights the user's personal style, characteristics and variety.

Please refer to FIG. 6 to FIG. 10. From FIG. 6 and FIG. 7, you see a larger sized of the present invention with a fixing plate 31 equipped with the decorative flake 32 and the bulb 321. One end of the fixing plate 31 is bended vertically to fix to the bumper 51 of the automobile with the curved breach 314 on the other end embedded onto the multi-direction slip-on assembly 1 to form another application mode wherein there are several rows of adjustable lock holes 318 either beneath the fixing plate 31 or above the combing plate 316 locked by bolts. Then slip the circular holes beneath the combining plate 316 to the multi-direction slip-on assembly 1.

In summary, the exhaust mechanism with adjustable angles and decoration functions for the present invention provides more functions than traditional mechanism and has broke through traditional technology bottleneck, which practically meets the qualifications for invention based on new type and improvement. Accordingly, an application is submitted for examination

What is claimed is:

1. A decorative and attractive exhaust mechanism with adjustable angles consisting of a multi-direction slip-on assembly, a formative exhaust cover and a decorative plate, characterized in that:

said multi-direction slip-on assembly is a rotary multi-direction shaft consisting of a positioning inlay, a multi-direction connector and a linking ring;

said formative exhaust cover is a replaceable cover with one opening inlaying interface at one end and several screw holes at adequate distances along an exterior edge to bolt to said linking ring, a formative mold is set on the other end with several holes for ventilation;

said decorative plate is composed of a fixing plate and a decorative flake, beneath said fixing plate, there is a curved breach at an adequate distance with several screw holes lying along said breach to fix on said linking ring.

2. The decorative and attractive exhaust mechanism with adjustable angles of claim 1, wherein said positioning inlay is a curved assembly connecting to said multi-direction connector, outside said positioning inlay there are several adjustable positioning holes for said positioning inlay to connect to a connecting interface by bolts locking a bolt lock hole with a bolt lock of said linking ring;

said multi-direction connector is a shaft consisting of a slip-on shaft and a curved connecting interface, wherein said connecting interface is connected inside said positioning inlay in a way to rotate in multiple directions with one end of said slip-on shaft connecting to an automobile exhaust, said connecting interface adapted to be combined within said positioning inlay on one end while the other end embedded to said linking ring; and said linking ring is a ring with an opening on either end and a blocker outside said linking ring, there are several equal-distant said locks outside said linking ring so as to connect said fixing plate to said fixing plate by passing said bolts through said screw lock holes.

3. The decorative and attractive exhaust mechanism with adjustable angles of claim 1, wherein said fixing plate is adapted to be attached to said decorative flake with screws or adhesion (such as twin adhesive) to provide a decorative and attractive exhaust mechanism with adjustable angles.

4. The decorative and attractive exhaust mechanism with adjustable angles of claim 1, wherein said decorative plate adapted to be connected with said multi-direction slip-on assembly by bolting or welding.

5. The decorative and attractive exhaust mechanism with adjustable angles of claim 1, wherein said decorative plate adapted to have several equal-distance LEDs sitting on an edge.

6. The decorative and attractive exhaust mechanism with adjustable angles of claim 1, wherein said fixing plate of said decorative plate adapted to be preformed into a N-shaped plate (as an end view) with a an inverted u-shaped spacer containing an adjustable trough on an back thereof, said spacer has a hook with another adjustable trough on an opposite side being able to be moved up and down for hooking on an automobile's trunk.

7. The decorative and attractive exhaust mechanism with adjustable angles of claim 1, wherein said fixing plate's back of said decorative plate adapted to be set with a combining plate so as to embed to a sliding trough on said fixing plate, thus said fixing plate is able to move up and down by adjusting said trough or lock holes before locking up with bolts.

8. The decorative and attractive exhaust mechanism with adjustable angles of claim 1, wherein said fixing plate and said decorative flake of said decorative plate are changeable by inserting said curved breach to said multi-direction slip-on assembly closely to form a one-piece assembly and placed on one or more exhausts.

* * * * *